United States Patent [19]

White et al.

[11] 4,255,119

[45] Mar. 10, 1981

[54] REFILLABLE GAS BURNING LIGHTER

[75] Inventors: Kenneth R. White; John P. Hancock, both of Indianapolis, Ind.

[73] Assignee: K-Whit Tools Incorporated, Indianapolis, Ind.

[21] Appl. No.: 34,460

[22] Filed: Apr. 30, 1979

[51] Int. Cl.[3] ..... F23Q 25/00

[52] U.S. Cl. ..... 431/150; 431/276; 431/344

[58] Field of Search ..... 431/130, 131, 150, 254, 431/276, 277, 344

[56] References Cited

U.S. PATENT DOCUMENTS

| | | | |
|---|---|---|---|
| 3,413,070 | 11/1968 | Piffath et al. | 431/89 |
| 3,521,985 | 7/1970 | Chrisman et al. | 431/151 |
| 3,523,005 | 8/1970 | Piffath et al. | 431/344 |
| 3,523,006 | 8/1970 | Piffath et al. | 431/344 |

*Primary Examiner*—Carroll B. Dority, Jr.
*Attorney, Agent, or Firm*—Jenkins, Coffey, Hyland, Badger & Conard

[57] ABSTRACT

A gas fueled lighter having a cylindrical body with a central bore forming a gas passage and a valve port. A check valve blocks flow from a reservoir to the passage, and contains a metering plug to pass gas to the passage. A valve plug threaded and sealed in the bore opens and closes the valve port. Such plug carries a turnknob head, contains a burner port from the gas passage, and carries a flame shield which supports a striker wheel. A flint is pressed against the wheel by a spring supported by a retainer plate on the valve plug. A cap threaded onto the body over the head has threads with the same lead as the valve plug threads so that if the cap is screwed onto the body when the valve is open, the cap will drivingly rotate the valve plug to closed position. A bottom flange on the cap and an O-ring in the body form a secondary seal to prevent fuel leakage and exclude dirt and moisture. The reservoir is filled by removing the valve plug and inserting a fill nozzle into the valve bore and against the check valve. In a modification, gas metering flow through the check valve is adjustably controlled by a rod screwed into the valve.

23 Claims, 6 Drawing Figures

REFILLABLE GAS BURNING LIGHTER

This invention relates to a refillable, liquefied-gas lighter, such as one which burns liquefied butane or other gas generally available on the market in pressurized refueling containers fitted with a fill nozzle.

It is the general object of the invention to provide a lighter adapted to serve as a survival lighter, as part of a survival kit for military use, and hence one adapted to hold a fuel charge for long-time intervals and to operate reliably after long periods of storage and despite adverse conditions such as exposure to temperature extremes and subjection to wet and dirty conditions and to physical abuse. It is a further object of the invention to provide an improved lighter meeting such conditions which is of simple construction and adapted to be made at low cost.

In accordance with the invention, the lighter comprises a body, preferably cylindrical, having a reservoir formed at one end thereof. A central bore in the body forms a supply passage for conveying fuel from the reservoir and defining a valve housing. A check valve mounted between the reservoir and the supply passage is biased to closed position in the direction of flow from the reservoir to the passage. A gas metering orifice or element, preferably a porous plug, is mounted in the check valve or in other bypassing relation with the check valve so as to pass gas from the reservoir to the gas passage at a desired rate for burning at a burner port. The bore has a threaded section, conveniently between two straight sections. A valve plug is threaded into the bore and has a sealing gasket adjacent its upper end and a valve closure element near its lower end. A port in the side of the valve plug above the closure element leads to an upper bore in the valve plug. The valve plug desirably carries a head which forms an operating handle for rotating the valve plug between open and closed positions and forms a valve port which receives gas from the plug bore. The head desirably has an upstanding peripheral flame shield. A striker wheel mounted in the flame shield is engaged by a flint mounted in the head and pressed upward by a spring supported by a retainer clipped onto a groove in the valve plug. A closure cap threads onto the upper end of the body and has a lower flange which is sealed to the body by a gasket so as to form a secondary seal for preventing escape of fuel and to protect the lighter from dirt and moisture. Desirably, the relationship is such that if the cap is threaded onto the body when the head is in valve-open position, it will engage the upper end of the head and drivingly rotate the head and valve plug to valve-closed position. To facilitate this, the valve threads and the cap threads desirably have the same lead. For rapid opening and closing of the valve plug, such threads may be double pitch threads.

The accompanying drawings illustrate the invention and show the best mode presently contemplated by the inventors of carrying out their invention. In such drawings.

Figure 6:
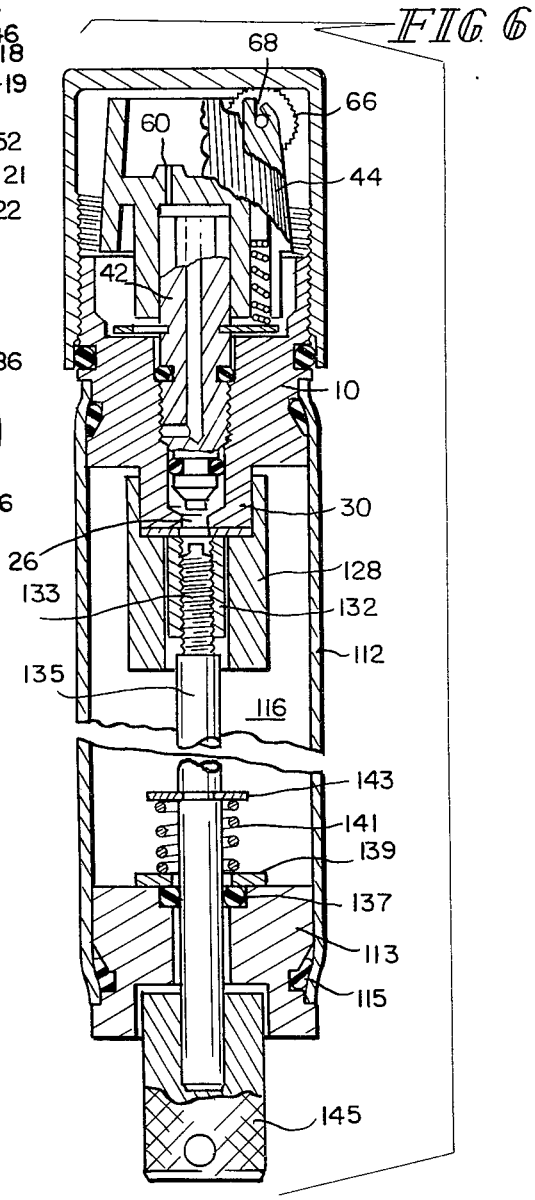
Figure 3:
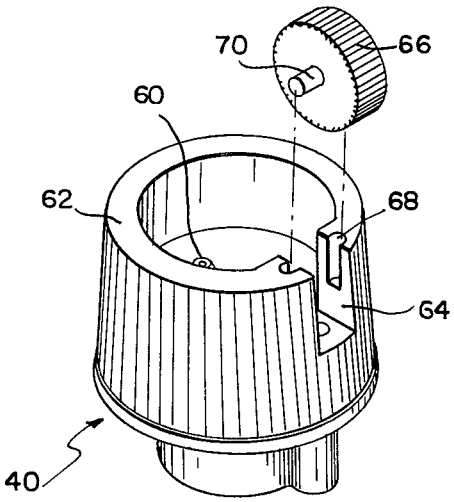
FIG. 3 is a perspective view of the valve head.
Figure 5:
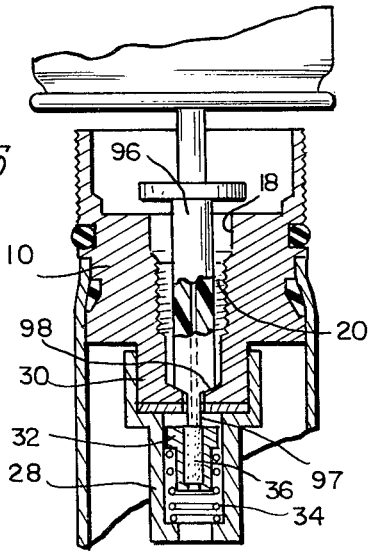

FIG. 5 is a fragmental view showing a fill nozzle inserted through the central bore or valve chamber of the lighter body and against the check valve to open that valve and admit charging fluid to the reservoir; and FIG. 6 is a substantially foreshortened view of a modified lighter in accordance with the invention, provided with a much elongated and enlarged fuel reservoir and with an adjustable metering orifice to vary the gas supply and hence the height of the flame.

The lighter shown in FIGS. 1-5 comprises a cylindrical body 10 having a lower end shaped to fit within the upper open end of a reservoir cup 12 and to have the edge of the cup crimped thereagainst with an O-ring 14 between the two so as to sealingly secure the cup to the body and form a fuel reservoir 16. The body has a central bore which includes an upper straight section 18 and intermediate threaded section 20 separated from the straight section 18 by a shoulder 19, a lower straight section 22 separated from the threaded section by a shoulder 21, and a bottom conical seat 24 about a central fuel port 26. A check valve housing 28 is fixed as with a press-fit on a bottom reduced diameter portion 30 of the body 10, and holds a gasket 31 against the lower face of the body. A check valve 32 is mounted in the housing 28 and biased upward against the gasket 31 by a spring 34. The check valve 32 has a central bore, closed at the top by a porous plug 36 adapted to pass gaseous fuel at a metered rate from the reservoir 16 through and past the check valve to the bottom port 26 of the central bore of the body.

Figure 1:
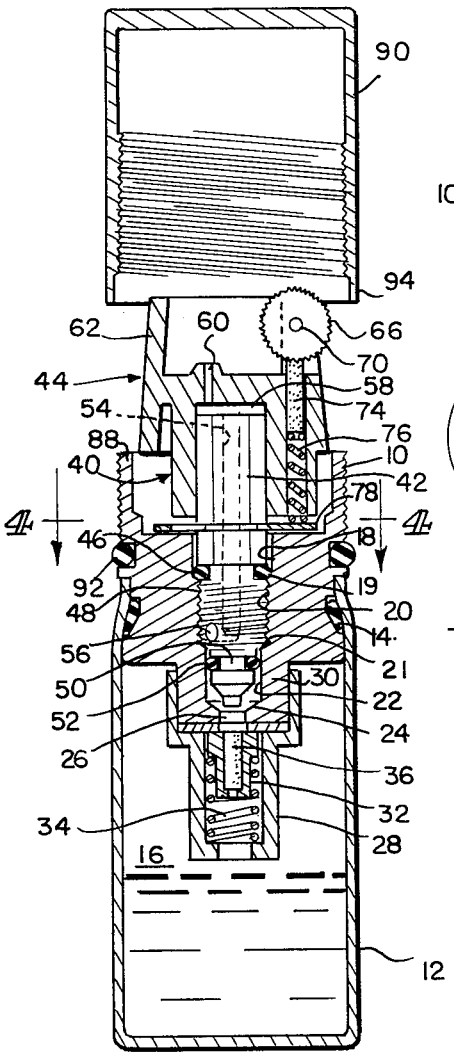
FIG. 1 is an axial sectional view of a lighter in accordance with the invention, showing the cap in partially removed position and showing the shut-off valve in closed position.
Figure 2:
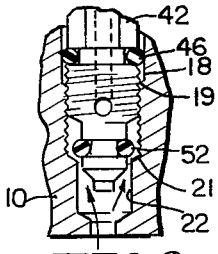
FIG. 2 is a fragmental view showing the shut-off valve in open position.

A valve plug 40 is mounted in the bore. It has an upper portion 42 of hexagonal or other non-circular cross section fixed as with a press-fit in a mating cavity in a valve head 44. The valve plug has an upper groove for the reception of a sealing O-ring 46 between the hexagonal upper portion 42 and a central threaded portion 48. It also has a lower groove 50 which contains a valve closure O-ring 52. Rotation of the valve assembly moves the closure O-ring between a closed position within the straight section 22 of the bore, as shown in FIG. 1, upward to an open position above the shoulder 21 at the bottom of the threaded section 20 of the bore, as shown in FIG. 2. The closure O-ring will be effective to close the valve over a range of positions along the straight section 22 of the bore so that there will be considerable tolerance in the relationship of that O-ring to other parts and in the exact closing position of the valve head. The valve plug 40 has a central bore 54 closed at the bottom but connected to a side port 56 which opens through the side of the plug adjacent the lower end of the threaded section 48.

Figure 4:
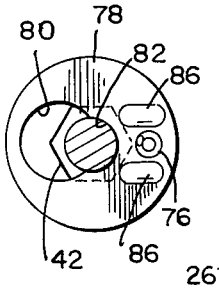
FIG. 4 is a sectional view taken on the line 4—4 of FIG. 1 showing the mounting of the back-up plate for the flint biasing spring.

The head 44 is formed with a central bottom cavity 58 which receives the upper end 42 of the valve plug and which communicates with a burner port 60 desirably offset from the central axis of the lighter. The head carries an upstanding peripheral collar 62 which forms a flame shield about the burner port 60. At a point diametrically opposite the burner port 60, the collar is thickened and formed with a slot 64 for the reception of a striker wheel 66. The sides of the slot are formed with vertical grooves 68 which receive the ends of the striker wheel shaft 70. The shaft is held in place by bending inward or staking the upper edges of the collar at the outside of the grooves 68, as indicated in dotted lines in FIG. 1 and in full lines in FIG. 6. Immediately below the striker wheel 66, the head has a bore 72 for a flint 74 which is spring-pressed upward by a spring 76 mounted between the flint and a back-up plate 78. As shown in FIG. 4, the back-up plate 78 is in the form of a circular washer containing a keyhole opening 80 having a large lobe adapted to pass the valve plug 42 and a reduced lobe 82 adapted to be engaged in a slot 84 in the valve plug. The back plate may be formed with bosses 86 to define a seat for the spring 76 so as to be held thereby against rotation in its mounting slot.

The upper end of the body 10 is formed with a collar 88, threaded on its outer surface to receive the internal threads of a cap 90. The body 10 desirably has a groove below the collar 88 for the reception of a sealing O-ring 92 adapted to make sealing engagement with a straight-sided edge flange 94 at the bottom of the cap. Desirably, the threads on the collar 88 and cap 90 are of the same pitch as the threads on the valve plug section 48 and central bore 20, and the length of the cap is such that if it is threaded onto the body when the head 44 and valve assembly is in open, unscrewed position, such cap will engage the upper portion of the head, for example, the upward-protruding edge of the striker wheel 66, and drivingly rotate the head and valve assembly to closed position. Thus, in effect, the cap bottoms out when its top wall engages the top of the head assembly as shown in FIG. 6, and the valve is in closed position.

Operation of the lighter shown in FIGS. 1–4 is as follows. Assuming the reservoir 16 to contain a charge of liquefied butane or other gas, gas under pressure will pass through the central bore of the check valve 32 and through the metering plug 36 into the bottom port 26 of the body 10 and the chamber immediately above that port. With that valve plug 42 in closed position, the valve closure O-ring 52 will sealingly engage the cylindrical wall of the straight section 22 of the bore and will close off flow of gas at that point. If the cap 90 is removed and the valve head 44 is manually rotated in a direction to unscrew the valve plug from the threaded section 20, the valve closure O-ring 52 will be carried upward past the shoulder 21, as to the open position shown in FIG. 2. Gas will then flow upward to the side port 56 and thence into the central bore 54 of the valve plug and to the burner port 60. Manual actuation of the striker wheel 66 will create a spark to ignite the gas in the usual manner. With the flame lighted at the burner port 60, the flow of gas to that port will be metered by the metering orifice action of the porous plug 36, and the porosity of such plug will be chosen to give a desired flame height.

To extinguish the flame 60, the head 44 is rotated in a closing direction so as to carry the valve plug downward in the central bore of the body 10 and to carry its valve closure O-ring 52 beyond the shoulder 21 and into sealing engagement with the cylindrical wall of the straight section 22.

As previously noted, if the flame should become extinguished and the cap 90 applied to the lighter without first manually rotating the head 44 to close the shut-off valve assembly, the top wall of such cap 90 will engage the upward protruding edge of the striker wheel 66 so as to drivingly rotate the valve assembly to closed position. Since the threads of the cap and the valve plug are of equal pitch, the plug and valve assembly will rotate together and advance together as the cap 90 is threaded onto the body. The plug will bottom out when its threaded section engages the shoulder 21 and the cap will bottom out against the top of the head, i.e., against the wheel 66. When the cap 90 is thus fully engaged, its lower straight edge portion 94 will make sealing engagement with the O-ring 92 so as to form a secondary seal to prevent loss of fuel and to form a primary seal to exclude dirt and moisture from the operating parts of the lighter.

For purposes of filling the lighter, the valve assembly comprising the valve plug 42 and the head 44 are unscrewed and removed from the body 10. This opens the central bore to allow the insertion of a filler nozzle 96 on a refill container of a type known and commonly available on the market. Such nozzle has a central tip 97 projecting beyond a shoulder 98. As shown in FIG. 5, the tip 97 extends through the bottom port 26 of the body and against the upper face of the check valve or of the plug 36 in that check valve, and thrusts the check valve to open position. Concurrently, the shoulder 98 on the nozzle may engage the conical shoulder 24 adjoining the port 26 so as to exert back thrust on the nozzle 96 and thereby actuate the release valve of the container to supply liquefied fuel under pressure through the nozzle 96 and its tip 97 to the reservoir 16. Conventionally, the tip 97 has a transverse groove at its end to prevent blocking the escape of gas from that tip. The filler container will normally be under a predetermined pressure related to the vapor pressure of the fuel, and fuel will flow into the reservoir 16 until its pressure has equalized with that of the fill tank. During this filling operation and in particular while the valve bore 18–26 is open, before inserting and after removing the fill nozzle, the porous plug 36 will permit gas to escape through and past the check valve 32, but this will be at the restricted slow rate controlled by the porosity of the plug and for only short time periods so as not to constitute a serious loss or hazard.

The modification of FIG. 6 is similar to that of FIGS. 1–4 except that it has a substantially larger reservoir and has an adjustable metering device. The upper end of the lighter is identical with that of FIG. 1 and has a body 10 containing a valve plug having a valve head 44, all with parts like those shown in FIG. 1. The reservoir 116 of this modification, instead of being formed of a cup 12 as in FIG. 1, is formed of a long length of tubing 112, the upper end of which is swedged onto the bottom portion of the body 10 in the same manner as in FIG. 1. The lower end of the tube 112 is closed by a plug 113 fixed and sealed in the tube by swedging its lower end against a sealing gasket 115 in a manner similar to the connection to the body 10.

The reduced lower end 30 of the body 10 carries a check valve housing 128 which has a central straight bore of hexagonal or other non-circular cross section. This contains a valve plug 132 having a central threaded bore which receives the threaded upper end 133 of a control rod 135. The lower end of such rod extends through the plug 113 and is sealed thereto by a sealing O-ring 137. A thrust washer 139 lies against the inner face of the plug 113 and is engaged by a spring 141 which bears against a snap-ring 143 fixed in a groove in the control rod 135, so as to bias the rod and the valve plug 132 upward against the seat provided by the gasket 131. The lower projecting end of the rod 135 carries a knurled handle 145 by which the rod can be rotated to vary the depth of threaded insertion of the rod end 133 in the valve body 132. One or both of such threads may be slightly tapered, and the clearance space between them establishes a gas metering passage through which gas may flow from the reservoir 116 to the bottom port 26 of the head. The rate of such metering flow will depend upon the depth to which the rod end 133 is threaded into the valve body 132, and hence may be varied and controlled by manually rotating the rod 135 by its handle 145. The upper end of the rod 135 extends close to the port 26 under normal conditions, so that the insertion of a filling nozzle as in FIG. 5 will engage that end and thrust the valve plug 132 away from its seat, against the bias of the spring 141, and open the valve for a filling operation.

Operation of this modified lighter is similar to that of FIGS. 1–4. The primary difference is that the rate of metered flow from the reservoir 116 to the bottom port 26 of the head 10 is controlled by the adjustable metering device provided by the threaded engagement of the rod end 133 with the valve body 132. The adjustment of these parts may normally be such as to provide a relatively low flame at the burner port 60 during burning operation of the lighter, but such flame may be lengthened by backing off the rod 133 to increase the clearance between its upper end and the valve plug, and thereby increase the flow of fuel from the reservoir 116 to the port 26 of the lighter body 10. Filling may be accomplished in substantially the same manner as shown and described in connection with FIG. 5. When the control rod 135 is adjusted for a low or moderate flame, the tip 97 of a fill nozzle 96 as shown in FIG. 5 will pass through the port 26 and engage the upper end of the rod 133 to thrust that rod downward against the biasing force of the spring 141 so as to open the check valve 132 and allow charging flow to occur. In the event the control rod 135 is backed off to such an extent that the tip of the nozzle will not reach the upper end of the rod, then filling cannot occur until the rod is threaded inward to bring its end into engageable position with the tip of the fill nozzle. This is desirable to avoid undue loss of fuel. With the metering passage in a bypassing relation with the check valve, metered flow will occur whenever the valve plug 42 is moved from its closed position sufficiently to open the shut-off valve, and will occur when the valve plug 42 and head 44 assembly is removed from the body 10 for purposes of filling. Accordingly, when the control rod 135 is backed off to such an extent as to provide a large bypass opening across the check valve 132, no filling operation can occur and it is necessary for the operator to turn the control rod forward to reduce the rate of metered flow to an acceptable level before the reservoir 116 can be filled. In a normal filling operation, the valve plug is out of its operative position for only a short period so that fuel loss is negligible.

The lighters of both modifications shown and described are of simple construction and adpated for manufacture at low cost. The body 10, the valve plug 42, the check valve 32 and its housing 28 are all adapted to be readily manufactured as inexpensive screw machine parts, the reservoir cup 12 and the cap 90 may be formed from aluminum extrusions, and the head 44 can be die cast to final configuration so as not to require machining. Assembly is accomplished largely by simple pressing and swedging operations. It is of advantage both for such manufacturer and in operation that all of the major parts are concentric about a common axis, which not only facilitates inexpensive screw machine manufacture, but tends to assure proper alignment and fit between the parts. The resulting lighter is sturdy and adapted to hold its fuel charge over long-time intervals and to operate reliably after long periods of storage and handling, and to withstand severe conditions and physical abuse. The lighter is convenient to use, even with one-hand operation as might be required under survival conditions, and is easy to refill from standard supply containers.

We claim:

1. A refillable, liquefied gas burning lighter, comprising
   - a body having an axial fuel passage therein,
   - a fuel reservoir for supplying fuel to the passage,
   - a burner port,
   - a check valve closing in the direction to block flow from the reservoir through the passage,
   - a manual shut-off valve for controlling flow of fuel from the passage to the burner port,
   - means operable when the shut-off valve is open and the check valve closed for supplying gas from the reservoir to said passage at a restricted rate for supporting ignition at the burner port,
   - said shut-off valve including a valve plug which is removable from the body and which thereby exposes the fuel passage for insertion of a fill nozzle against the check valve in a direction to open the same to pass fuel from such nozzle to the reservoir.

2. A lighter as in claim 1 in which said means for supplying gas to the shut-off valve forms a flow path which bypasses the check valve.

3. A lighter as in claim 2 in which said means comprises a restricted passage through the check valve.

4. A lighter as in claim 3 in which said restricted passage comprises a porous plug in the check valve.

5. A lighter as in claim 4 in which said body and fuel passage are formed to receive a fuel nozzle having a tip which engages the check valve to thrust it open during filling.

6. A lighter as in claim 5 in which said fuel passage is formed with a shoulder adjacent the check valve, adapted to sealingly engage a shoulder on the fill nozzle when the tip has opened the check valve, to seal the nozzle and exert rearward thrust thereon to activate the fuel nozzle.

7. A liquefied gas burning lighter, comprising
   - a body having an axial valve chamber formed therein,
   - a fuel reservoir for supplying fuel to said chamber,
   - a valve plug and burner head assembly threaded into said chamber, the burner head projecting upward from the valve plug and the plug being rotatable downward to a closed position in which it shuts off fuel flow from the reservoir,
   - and a cap threaded onto said body for covering the burner head,
   - the valve plug threads and the cap threads having the same pitch and the cap and head being so constructed and arranged that in the event the cap is threaded onto the body while the valve plug is above its closed position, the cap will engage and rotate the head and thereby rotate the valve plug to its closed position.

8. A lighter as in claim 7 further comprising means for sealing the cap to the body when the cap has moved to a stop position against the closed valve and head assembly.

9. A lighter as in claim 7 further comprising a circumferential sealing gasket on said body or cap and a cylindrical sealing surface on the other of said elements which makes sealing engagement with the gasket as the cap approaches its fully installed position.

10. A lighter as in any of claims 7, 8, or 9 in which the burner head includes a burner port and a striker wheel which protrudes upward to form the top-most surface of the head, the wheel being mounted eccentrically in a generally radial plane so as to present a generally radial abutment surface, and the cap includes a circular surface in position to frictionally engage such abutment surface.

11. A refillable, liquefied gas burning lighter, comprising a generally cylindrical body, a coaxial tubular wall forming a fuel reservoir at the bottom of the body, a coaxial bore forming a valve seat in the body and a fuel passage therethrough, a valve member threaded into such bore and having a valve plug cooperating with said seat to form a shut-off valve, a burner head on the valve member within the projected area of the body, forming a burner port and provided with a sparking wheel, and a cap threaded on the body and enclosing the head.

12. A lighter as in claim 11 in which the bore has upper and lower straight portions and a reducing shoulder at the upper end of said lower portion, and said member has an upper sealing gasket for sealing the same in the bore and a lower valving gasket which moves out of the lower straight portion to open the bore to passage of fuel from the reservoir and moves past said reducing shoulder and into the lower straight portion to shut off passage of fuel from the reservoir, a gas passage in the valve member opening through the side thereof between the said gaskets and extending upward to supply fuel to the burner port in the head.

13. A lighter as in claim 11 or 12 with the addition of a sealing gasket between the cap and body, forming a secondary seal against escape of fuel from the lighter and a primary seal to protect the head from dirt and moisture.

14. A lighter as in claim 11 with the addition of a coaxial check valve at the lower end of the bore, closing in the direction of flow from the reservoir, and means for supplying gas from the reservoir past the check valve for supporting ignition at the burner, the valve member being removable to open the bore for insertion of a fill nozzle to supply fuel under pressure through the check valve in its opening direction to charge the reservoir.

15. A lighter as in claim 12 with the addition of a coaxial check valve at the lower end of the bore, closing in the direction of flow from the reservoir, and means for supplying gas from the reservoir past the check valve for supporting ignition at the burner, the valve member being removable to open the bore for insertion of a fill nozzle to supply fuel under pressure through the check valve in its opening direction to charge the reservoir.

16. A lighter as in claim 14 or 15 in which said means for supplying gas comprises a porous plug in a passage through the check valve, adapted to pass gas at a restricted rate.

17. A lighter as in claim 11 in which said head carries a striker wheel and contains an eccentric, axially disposed bore to receive a flint, a spring for biasing said flint toward the striker wheel and a retainer plate for supporting the spring in said flint bore, said retainer plate having a central opening defined by a C-shaped edge, and said valve member having a circumferential groove below the head in which the disk is supported by engagement of said edge in said groove, said disk being shaped to define a spring seat so as to be held by the spring against rotation in said groove.

18. A refillable liquefied gas burning lighter, comprising a body having a fuel reservoir attached thereto, a valve member threaded into said body and forming a shut-off valve therewith, a head on said valve member having a burner port connected to receive fuel from said valve, and having a striker wheel mounted eccentrically of the head, an eccentric, axially-disposed bore in the head for holding a flint in contact with the wheel, a spring in said bore for urging the flint against the wheel, and a spring retainer plate having a central opening defined by a C-shaped edge, said valve and head assembly having a groove below said flint-receiving bore in which the plate is mounted by engagement of said edge therein, said plate being shaped to interengage with said spring so as to be held thereby from rotation.

19. A lighter as in claim 18 in which said retainer plate is a generally circular plate and the body includes a peripheral wall within which the plate is housed so as to be trapped thereby against displacement from its mounting groove.

20. A lighter as in claim 1 or 3, in which said reservoir is formed by an elongated tubular wall having a closure at its lower end, said check valve comprises a valve plug, means for guiding said plug in non-rotating axial movement against a seat at the lower end of the body, a control rod connected to said valve plug and rotatable therein, means forming an adjustable gas passage through the valve plug adjustable by rotation of said rod, said rod extending through the end closure of the reservoir and being rotatable therein to effect such adjustable control, sealing means between the rod and enclosure, said rod being axially movable and means biasing said rod toward said check valve so as to bias the valve plug to closed position.

21. A lighter as in claim 1 in which said reservoir is formed by an elongated tubular wall having a closure at its lower end, said check valve comprises a valve plug guided for non-rotating axial movement against a seat at the lower end of the body, a control rod connected to said valve plug, means forming an adjustable gas passage through the valve plug adjustable by rotation of said rod, said rod extending through the end closure of the reservoir and being rotatable to effect such adjustable control, and sealing means between the rod and end closure.

22. A lighter as in claim 21 in which said rod is axially movable and is biased toward said check valve by a spring acting between said closure and the rod so as to bias the valve plug to closed position, said rod being threaded into the valve plug by threads which define said gas passage therethrough, said passage being adjustably variable by screwing the rod into and out of the valve plug.

23. A lighter as in claim 11, in which said reservoir is formed by an elongated tubular wall having a closure at its lower end, a check valve closing in the direction to block flow from the reservoir through said fuel passage, said check valve comprising a valve plug, means for guiding said plug in non-rotating axial movement against a seat at the lower end of the body, a control rod connected to said valve plug and rotatable therein, means forming an adjustable gas passage through the valve plug adjustable by rotation of said rod, said rod extending through the end closure of the reservoir and being rotatable therein to effect such adjustable control, sealing means between the rod and end closure, said rod being axially movable and means biasing said rod toward said check valve so as to bias the valve plug to closed position.

* * * * *